United States Patent [19]

Eriksson

[11] 4,213,822

[45] Jul. 22, 1980

[54] APPARATUS FOR DISPLACEMENT WASHING OF FIBROUS MATERIAL SUSPENDED IN A LIQUID

[76] Inventor: Erik S. Eriksson, Råstorpsvägen 12, S-653 49 Karlstad, Sweden

[21] Appl. No.: 950,873

[22] Filed: Oct. 12, 1978

[51] Int. Cl.[2] ..... D21C 9/02

[52] U.S. Cl. ..... 162/242; 68/181 R; 162/243

[58] Field of Search ..... 162/242, 248, 60, 41, 162/19, 243; 68/181 R; 8/156, 158

[56] References Cited

U.S. PATENT DOCUMENTS

| | | | |
|---|---|---|---|
| 3,475,271 | 10/1969 | Laakso | 162/242 |
| 3,595,038 | 7/1971 | Bergholm et al. | 162/60 X |
| 3,787,284 | 1/1974 | Richter | 162/243 X |
| 3,807,202 | 4/1974 | Gunkel | 68/181 R |
| 3,814,663 | 6/1974 | Ingemarsson | 162/60 |

FOREIGN PATENT DOCUMENTS

| | | | |
|---|---|---|---|
| 927164 | 5/1973 | Canada | 162/342 |

*Primary Examiner*—Richard V. Fisher

*Attorney, Agent, or Firm*—Sughrue, Rothwell, Mion, Zinn and Macpeak

[57] ABSTRACT

Apparatus for the displacement washing of cellulose fibers suspended in a liquid, as produced by cooking wood pulp in a digester vessel 1. As the fiber suspension settles to the bottom of the vessel it passes through a plurality of axially spaced washing zones 6, whereat water is forced through the suspension in a radial direction from central inlet conduits 16, 16*a,* 16*b* to peripheral outlet chambers 9, or vice versa. Such flow displaces the suspension or cooking liquid, and the washed fibers are withdrawn through a bottom outlet 5. The washing liquid is sequentially recirculated through the zones 6 for economy, and the buildup of fibers on the recirculating conduits 19*a,* 21*a,* 24*a* in the vessel is prevented by perforated water discharge pipes 26 disposed just above the conduits.

7 Claims, 3 Drawing Figures

APPARATUS FOR DISPLACEMENT WASHING OF FIBROUS MATERIAL SUSPENDED IN A LIQUID

BACKGROUND OF THE INVENTION

This invention relates to apparatus for displacement washing of fibrous material suspended in a liquid and is particularly adapted for washing fibrous, cellulosic materials that have been treated in a pulp digester.

Cellulose fibers are liberated and obtained from wood pulp and other cellulosic materials by cooking a suspension of the material in a liquid, typically in a pulp digester. The suspension liquid is then separated or washed from the fibers to the maximum extent possible.

One known technique for washing a suspension of cellulose fibers is by passing a washing liquid through the fibrous material to displace the suspension liquid. With batch digesters, displacement washing is often accomplished by admitting washing liquid directly into the digester upon completion of cooking, thereby washing the full contents of the digester. A later development involves the use of so-called diffusers, in which a thick bed of fibers, after removal from the digester, is purged of suspension liquid over a prolonged period of time by a washing-liquid flow.

Washing by displacement is also utilized in connection with continuous pulp digesters, with the digester normally being elongated at its lower end to provide a washing zone downstream of the cooking zone. The washing liquid is usually introduced at the bottom of the washing zone and flows generally upward through the digested chip material as it proceeds towards the digester outlet.

A principal disadvantage of displacement washing, as heretofore practiced, is that it is difficult to achieve uniform distribution of the washing-liquid flow throughout the full length and depth of the defibered chip material. As cellulose material, for example, wood chips often varies considerably as to digestability owing to various factors such as habitat, size, shape, etc., small zones of slightly different degrees of digestion, and hence of differing resistance to the flow of liquid therethrough, frequently exist within the digester. The result is that canals tend to be formed within the material bed by the washing-liquid flow. Consequently, the material is not uniformly purged of suspension liquid. The likelihood of canalization occurring increases with the thickness of the bed within the digester since the washing liquid must travel along correspondingly lengthened flow paths.

Moreover, the risk of canalization remains even if the digested chips are transferred to a separate vessel for washing, and this notwithstanding that the chips are defibered to a great extent upon removal from the digester. Here, uneven packing of the material within the vessel may lead to the formation of canals, or a certain degree of flow canalization may also occur along the smooth side walls of the vessel. Non-uniform distribution of the washing liquid results; and those areas of the bed of higher resistance to liquid flow are not satisfactorily washed.

SUMMARY OF THE INVENTION

There is provided, in accordance with the invention, a novel and improved apparatus for displacement washing of fibrous material, such as cellulosic material, that overcomes the disadvantages associated with presently-known washing arrangements of the foregoing types and provides important advantages in its own right, such as requiring a minimum of washing liquid and affording sufficiently thorough washing within a continuous digester of many pulp qualities as to eliminate the need for subsequent washing outside of the digester.

More particularly, an apparatus constructed according to the invention includes, in a preferred embodiment, a washing vessel, which in a continuous digester preferably comprises the lower end of the digester itself, of substantially symmetrical cross section, one or more inlets for the washing liquid disposed along the axis of symmetry of the vessel or along axes parallel thereto, and a peripherally extending chamber for withdrawing the displaced suspension liquid defined by the outer wall of the vessel and a perforated sieve-like member exposed to the fibrous material suspension. The chamber, hereinafter referred to as the washing chamber, communicates with an associated further chamber through a constriction of fixed through-flow area for determining the liquid flow from said washing chamber to said further chamber.

Washing liquid is introduced under pressure into the fibrous material bed substantially at its longitudinal centerline, i.e. along the axis of symmetry of the vessel or along axes which are parallel to said axis of symmetry, and over the full axial extent of the washing zones or washing chambers, from whence it flows radially through the bed, displacing the suspension liquid and forcing it through the perforated members into the washing chambers. Accordingly, the flow paths over which the washing liquid displaces the suspension liquid are of substantially equal length throughout the entire material bed. In addition, by suitable dimensioning of the fixed through-flow orifice of the constriction, equal volumetric flow rates of suspension liquid may be maintained through the individual cells, thus assuring substantially uniform flow distribution per unit area of the perforated cell walls and hence uniform washing of the digested pulp. Each of the washing-liquid introducing means includes a recycling conduit or a fresh washing-liquid which is connected to a respective washing zone of said vessel, thereby to conserve washing liquid as hereinafter explained.

Further advantages are realized in accordance with the invention by partitioning the peripheral chamber transversely of the axis of symmetry of the vessel so as to divide the cells into two or more axially-spaced, annular sections and by providing separate inlets for introducing washing liquid opposite the axial location within the vessel of each cell section. As the suspension liquid displaced by the separate washing-liquid flows is withdrawn principally through the associated cell section, flow paths of substantially equal length are afforded notwithstanding that beds of considerable thickness are to be washed. As a further feature of the invention, the suspension liquid drained off by one or more of the downstream cell sections may be recycled to the inlet or inlets for one or more preceding section. Also, the fixed constrictions have a through-flow area such that the volume of suspension liquid drawn off by any particular section of cells is substantially the same as the volume of washing liquid supplied to that section. This not only contributes to minimizing the amount of washing liquid required, but also aids in achieving proper flow distribution.

If desired, and in accordance with the invention, the washing liquid may be introduced under pressure through the peripheral cells and the displaced suspension-liquid collected along the vessel axis or along axes parallel to and adjacent to said vessel axis. For this purpose, the axially disposed inlet structure for supplying washing liquid is given a perforated or slotted sieve-like construction, so that, upon reversal of the flow direction, it may also function to withdraw the radially inward flow of suspension liquid while remaining substantially impervious to the fibrous material. The fixed constrictions are arranged such as to supply washing liquid to each cell at a constant volumetric flow rate, and a corresponding quantity of suspension liquid is displaced and drained off.

The apparatus of the invention has particular application to the displacement washing of cellulosic material in a continuous pulp digester. Indeed, in a digester of this type which has been provided with a washing zone suitably proportioned according to the invention, it is possible to obtain such sufficiently thorough washing of many pulp qualities that subsequent washing outside of the digester is not required.

DESCRIPTION OF THE DRAWINGS

For a better understanding of the invention, reference may be made to the following description of exemplary embodiments, taken in conjunction with the figures of the accompanying drawing, in which.

DESCRIPTION OF AN EXEMPLARY EMBODIMENT

Figure 1:
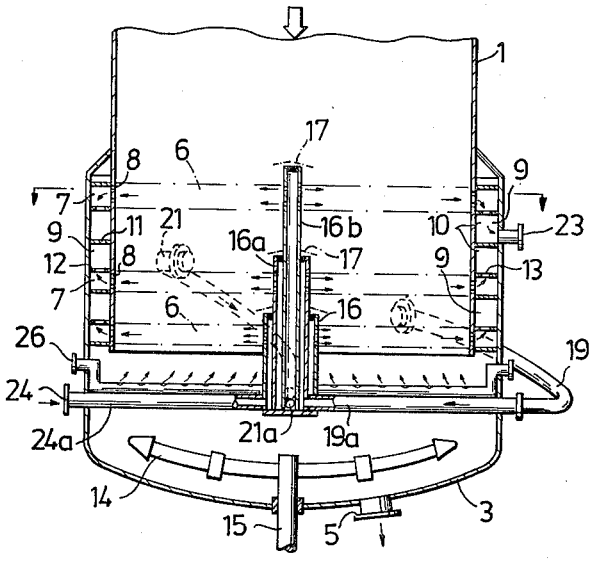
FIG. 1 is a vertical sectional view, generally in schematic form, of a displacement-washing apparatus constructed in accordance with the invention.
Figure 2:
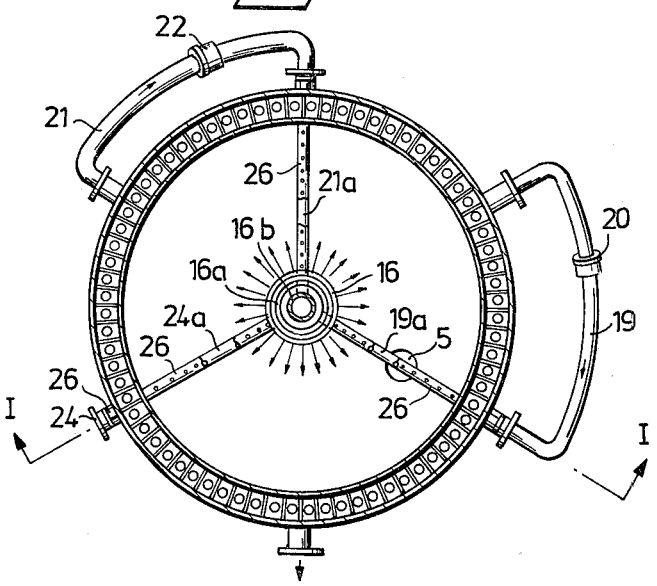
FIG. 2 is a horizontal sectional view of the apparatus of FIG. 1, taken along the line 2—2 and looking in the direction of the arrows.
Figure 3:
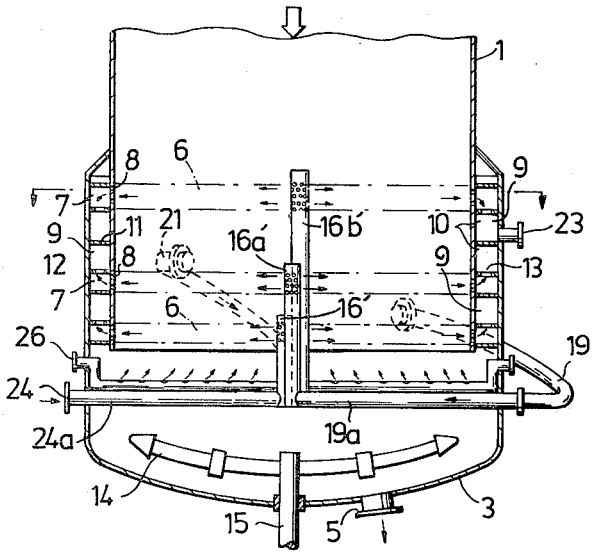
FIG. 3 is a vertical sectional view, generally in schematic form, of a further embodiment of an apparatus constructed in accordance with the invention.

The embodiment of the apparatus shown in FIGS. 1, 2 and 3 is depicted as comprising the lower end, or an extension of the lower end, of a vertical, cylindrical digester. It will be understood, however, that although the invention has particular application in combination with such a digester, this is illustrative only, and that the apparatus may be utilized with other material treating equipment or may take the form of a separate, closed vessel for washing fibrous materials independently of other equipment.

As portrayed in FIG. 1, one exemplary embodiment of the apparatus includes, according to the invention, a pressure vessel 1 having a substantially symmetrical cross section about a central axis of symmetry. The vessel is closed at its discharge end by a dished header 3 peripherally joined to the wall of the vessel. An outlet port 5 is provided in the header 3 for discharge of the digested pulp.

The interior of the vessel is divided into three axially spaced washing zones, or displacement zones 6, which terminate radially in a respective annular washing chamber 7 defined by a sieve-like member 8 which is perforated or slotted in a manner to be pervious to the suspension or washing liquid but impervious to the cellulosic material, and which extends around the inner periphery of the vessel spaced from the outer wall thereof. Located immediately above or immediately beneath a respective annular washing chamber 7 is a further chamber 9. Each further chamber is defined by a member 10 which extends around the inner periphery of the outer wall of the vessel 1 in line axially with respective sieve-like members 8, and first and second, mutually parallel and spaced-apart partition walls 11, 12 which extend radially from said outer wall of said vessel 1 to the respective extremities of said members 10, said members 10 being impermeable both to the displacement and washing liquid and to the cellulosic material.

Each of the annular washing chambers 7 communicates with its associated further chamber 9 through a constriction 13 of fixed through-flow area, arranged in an associated partition wall 12 separating said two chambers.

Turning now to the interior of the vessel 1 illustrated in the figures, a rotatable agitator 14 is provided adjacent the upper surface of the header 3. The agitator is supported in this position for rotation by a tubular shaft 15 mounted coaxially with the vessel axis. Concentric conduits 16, 16*a* and 16*b* (FIGS. 1 and 2), by means of which washing liquid is applied to or suspension liquid is removed from respective washing zones, as the case may be, extend into the vessel along the vessel axis. The outer conduit 16 serves the lower washing zone and therefore is of an axial extent substantially coextensive with the axial extent of that zone, where it is sealed off as, for example, by a tapered closure (not shown) that establishes a liquid-tight seal with the conduit 16*a*. The conduit 16*a*, on the other hand, is intended to service the center one of the three washing zones 6, hereinafter referred to as the intermediate zone, and will thus extend to the upper radial defining plane of said intermediate zone, while the conduit 16*b* is intended to extend to the upper, radial plane of the uppermost of the washing zones 6, thereby to service said uppermost zone. The surfaces of the conduits 16, 16*a* and 16*b* exposed to the fibrous material suspension are perforated or slotted about the peripheries thereof, so that each has a sieve-like construction, suitably configured to transmit liquid while retaining the fibrous material, over only so much of its length as is generally coextensive with the axial extent of the associated, opposed washing zone 6. Again, if more than three washing zones are provided, a like number of additional conduits 16 are preferably used. Baffle means 17 may be arranged adjacent the tops of of respective conduits 16, 16*a* and 16*b*, to direct the flow of washing liquid radially outwardly of said conduits, towards respective sieve-like members 8, although it will be understood that said baffle means will not impede the flow of cellulosic material through the vessel.

In the operation of the apparatus shown in the Figures, cellulosic material to be digested by cooking is supplied continuously to the input end (not shown) of the pressure vessel 1, i.e. the digester. After passing through a cooking zone (also not shown), the fibrous suspension enters the washing or displacement zone, as indicated by the vertical arrows at the upper end of FIG. 1. In one mode of operation, washing liquid is delivered to the vessel 1 by the conduits 16, 16*a* and 16*b* at a pressure exceeding the internal vessel pressure, and is introduced radially into the suspension through the sieve-like portions of the conduits (see the solid arrows in FIG. 1). Since the input pressure of the washing liquid is greater than that within the fibrous suspension, the washing liquid displaces a corresponding quantity of the suspension liquid as it flows outward through the material bed. The displaced suspension liquid is thus forced through the sieve-like members 8 into the respective washing chambers 7. This strained-off liquid is drained into the associated further chamber 9 through associated fixed constrictions 13.

It will be apparent, therefore, that a radial flow of liquid is established in directions away from the central conduits 16, 16*a* and 16*b*, by virtue of which the suspension liquid is displaced by the washing liquid along paths of flow generally perpendicular to the direction of movement of the fibrous material within the vessel 1. Consequently, the flow paths followed by the washing liquid are of generally equal length throughout the washing zone. Canalization owing to variations in the distance of travel of the washing liquid through the material bed is accordingly eliminated or substantially reduced by the present invention.

Moreover, by appropriate sizing of the through-flow area of constrictions 13, the volume of suspension liquid flow per unit of time, i.e. the volumetric flow rate, drained through the washing chambers may be maintained substantially equal among the washing chambers of each or all the washing zones. In other words, each washing chamber of a washing zone, or of all said zones, receives an equal quantity of suspension liquid per unit of time. As a consequence, the quantity of liquid flow per unit area is at least approximately the same along the whole surface of the members 8, with the result that a uniform distribution of the washing liquid is achieved throughout the material suspension. Thorough and uniform washing of the material is thus provided. With a continuous digester having a washing zone (beyond the cooking zone) suitably proportioned in accordance with the invention, in particular, it is possible to achieve such complete displacement of the suspension liquid in many pulp qualities as to render subsequent washing outside of the digester unnecessary.

As mentioned, the through-flow area of the fixed restrictions 13 is preferably determined so that the total volume of suspension liquid withdrawn generally equals the volume of washing liquid supplied. Control of the liquid flow in this way contributes to minimizing the quantity of washing liquid required.

As another feature of the invention, further tending to reduce the volume of washing liquid consumed during a washing process, the washing liquid withdrawn from the lowermost and intermediate washing zones 6 may be recycled to the conduits 16*a* and 16*b* respectively, and used as washing liquid in cleaning the portions of the fibrous bed located in the intermediate and upper washing zones of the apparatus. To this end a suitable recycling circuit including, for example, conduit 19, 19*a* and pump 20 is connected to the further chamber 9 of the lowermost washing zone 6 and to the conduit 16*a*, whilst a similar recycling circuit including, for example, conduits 21, 21*a* and pump 22, is connected to the intermediate washing zone 6 and the conduit 16*b* which is intended to service the uppermost washing zone. Washing liquid strained-off from the uppermost washing zone is taken to a recovery apparatus or through appropriate treatment equipment or is discharged to waste through an outlet 23. Fresh-washing liquid is supplied under pressure to the conduit 16 serving the lowermost washing zone, through a conduit system 24, 24*a*. The conduits 19*a*, 21*a*, and 24*a* of respective conduit systems are fixedly arranged above the rotatable agitator and each leads to an associated one of the conduits 16, 16*a*, 16*b*.

During washing, the fibrous suspension is prevented from settling onto each of the stationary conduits 19*a*, 21*a* and 24*a* connected to the conduit 16, 16*a* and 16*b*, by means of perforated pipes 26, one of each of which is located immediately above a respective conduit. Liquid fed to the pipes 26 is forced out into the fibrous bed immediately above said conduits, thereby preventing the fibrous material from settling thereon, said fibrous material falling instead onto the bottom of the vessel, to be discharged through the port 5. Fibrous suspension is prevented from settling at the bottom of the vessel by the agitator 14.

The apparatus of FIGS. 1 and 2 may also be operated, if desired, with reversed flow of the washing liquid. In this mode, the washing liquid is supplied at suitable pressure to the respective further chambers 9 through the conduit systems 19, 20; 21, 22 and 23, and thence to the washing chamber 7 by way of the constrictions 13. The constrictions 13 are dimensioned to deliver the liquid to the respective chambers 7 at substantially equal rates of flow. Thereafter the washing liquid is caused to flow through the sieve-like members 8 and radially inward towards the center of the vessel 1. Suspension liquid displaced by the washing liquid is drawn off through the conduits 16, 16*a* and 16*b* in a quantity corresponding generally to the quantity of washing liquid supplied.

It will be understood by those skilled in the art that the above described embodiment is susceptible of modification and variation without departing from the spirit of the invention. For example, the number and size of the chambers 7 may be varied to suit the requirements of a given application. Axial division of the washing zones or chambers, and of the associated liquid supply and removal means likewise may differ from the arrangement shown in FIGS. 1 and 2.

Further, instead of conduits which are coaxial with one another, the conduits for servicing respective washing zones may be arranged adjacent each other in a manner such that the long axes of said conduits are parallel to one another and to the central axis of the vessel without said conduits being coaxial. In this case each conduit shall be perforated only along that part of its length which is commensurate with the height of the washing zone to be served above the bottom of the vessel. Accordingly, all such modifications and variations are intended to come within the scope of the invention as defined by the following claims.

FIG. 3 illustrates a variant of the apparatus shown in FIGS. 1 and 2 in which the liquid-introducing or liquid-removal conduits 16, 16*a* and 16*b* instead of extending co-axially with one another, lie adjacent each other with the long axes of said conduits parallel with the central axis of the vessel 1. As with the embodiment of FIGS. 1 and 2, the conduit 16 is intended to serve the lowermost of the washing zones 6, the conduit 16*a* is intended to serve the intermediate washing zone, and the conduit 16*b* the upper washing zone. Consequently, the conduits are perforated along lengths thereof which are co-extensive with the respective zone which they are intended to serve.

The embodiments of the invention in which an exclusive property or privilege is claimed are defined as follows:

1. Apparatus for displacement washing of fibrous material suspended in a liquid comprising:

(a) a vessel having a substantially symmetrical cross section about an axis of symmetry and having an axially spaced inlet and outlet for a fibrous material-liquid suspension, (b) a plurality of means disposed substantially on or adjacent the axis of symmetry of the vessel for introducing washing liquid into the interior of the vessel to displace suspension liquid from the fibrous material in selected zones of said vessel, (c) means including at least one member pervious to the suspension liquid and substantially impervious to the fibrous material defining, together with the outer wall of the vessel, axially spaced and peripherally extending washing chambers for receiving liquid displaced from the fibrous material in respective ones of said selected zones, (d) means including at least one member impervious to the suspension liquid and to the fibrous material defining further chambers with the outer wall of said vessel, said further chambers being located above or beneath a respective washing chamber peripherally of said vessel, (e) restriction means of fixed flow-through area for communication of a washing chamber with an associated further chamber, said restriction means being arranged to control the flow of suspension liquid from said washing chamber to said associated further chamber, whereby substantially uniform distribution of the washing liquid flow through the fibrous material at any given cross section transverse to the vessel axis is obtained, (f) means for recycling washing liquid drawn off from selected ones of said zones to selected others of said zones, said means comprising, for each of said washing-liquid introducing means, a conduit which is stationarily arranged in said vessel and which forms part of a conduit system extending between said selected one of said zones to said selected other of said zones in communication therewith, (g) means for preventing the buildup of fibrous material on said recycling conduits comprising a perforated pipe disposed immediately above each of said recycling conduits for injecting liquid into the fibrous material located in the vicinity thereof to prevent said material from settling on said conduits, and (h) a rotary agitator disposed just above the bottom of the vessel and below the recycling conduits for imparting rotary motion to the fibrous material to prevent fibrous material from settling at the bottom of the vessel.

2. An apparatus according to claim 1 in which the through-flow area of said constrictions is determined to permit the volumetric flow rate to be made substantially equal among the washing zones and washing chambers.

3. Apparatus according to claim 1 in which each means for introducing washing liquid into the vessel includes at least one conduit extending substantially along the axis of symmetry of the vessel or adjacent to and parallel with said axis, the conduit being pervious to the washing liquid at least over a length substantially coextensive with the axial extent of the associated washing zone.

4. In a vertical digester of substantially horizontal cross section through which fibrous material suspended in liquid is continuously conveyed and wherein the material is washed in zones adjacent the lower end of the digester, the improvement comprising:

(a) liquid-pervious means disposed within the washing zones and substantially on or adjacent to and parallel with the axis of symmetry of the digester, said means being substantially impervious to the fibrous material.

(b) means within the washing zones including at least one member pervious to liquid and substantially impervious to fibrous material defining peripherally extending chambers with the inner wall of the digester, (c) means dividing the chambers substantially horizontally into a multiplicity of separate, axially spaced cells each constituting the radially outermost boundary of a washing zone within the vessel, (d) fixed constrictions of non-changeable through-flow area associated with each cell for determining liquid flow therethrough, whereby washing liquid may be introduced into the fibrous material through one of said axially disposed liquid-pervious means or said peripherally spaced cells and suspension liquid displaced from the fibrous material may be withdrawn through the other of said axially spaced liquid-pervious means or said peripherally spaced cells and whereby substantially uniform distribution of the washing liquid flow through the fibrous material at any given cross section transverse to the vessel axis and in each imaginary segmental zone can be achieved, (e) individual means for recycling washing liquid from respective washing zones to selective ones of said cells comprising a plurality of stationary conduits extending radially outwardly of the central axis of said vessel, (f) means for preventing the buildup of fibrous material on said recycling conduits comprising a perforated pipe disposed immediately above each of said recycling conduits for injecting liquid into the fibrous material located in the vicinity thereof to prevent said material from settling on said conduits, and (h) a rotary agitator disposed just above the bottom of the vessel and below the recycling conduits for imparting rotary motion to the fibrous material to prevent fibrous material from settling at the bottom of the vessel.

5. A digester according to claim 4 in which the fixed through-flow area of the constrictions permits the volumetric flow rate to be made substantially equal among the cells.

6. A digester according to claim 5 wherein the washing liquid is introduced into the fibrous material through the axially disposed liquid-pervious means and the displaced suspension liquid is withdrawn through the peripherally spaced cells.

7. A digester according to claim 5 wherein the washing liquid is introduced into the fibrous material through the peripherally spaced cells and displaced suspension liquid is withdrawn through the axially disposed liquid-pervious means.

* * * * *